United States Patent [19]

Weeks et al.

[11] 3,995,459

[45] Dec. 7, 1976

[54] LOCK ASSEMBLIES

[75] Inventors: Wilfred Gwyn Weeks; Malcolm Arthur Taylor, both of Bristol, England

[73] Assignee: Weeks and Taylor Limited, Bristol, England

[22] Filed: July 10, 1975

[21] Appl. No.: 594,616

[30] Foreign Application Priority Data

July 11, 1974 United Kingdom ..... 30821/74

[52] U.S. Cl. ..... 70/13; 70/34

[51] Int. Cl.[2] ..... E05B 65/48

[58] Field of Search ..... 70/2–15, 70/18, 23, 32–34, 229–232, 337, 339, 395, 419, DIG. 60; 292/281

[56] References Cited

UNITED STATES PATENTS 1,692,825 11/1928 Ganz ..... 70/232

1,764,367 6/1930 Szymanski ..... 70/8

*Primary Examiner*—Robert L. Wolfe

*Attorney, Agent, or Firm*—Mason, Kolehmainen, Rathburn & Wyss

[57] ABSTRACT

A lock assembly comprises a stud for mounting on one member such as a door, a plate for pivotal mounting on another member and a separate locking member for locking the plate to the stud having locking mechanism comprising a cylinder slidable in the locking member and onto the stud, a ball movable through the cylinder wall from a locking position where it engages a groove in the stud and an unlocked position, a ring catch for holding the cylinder and thus the ball in their locked positions and a key-operated lock for operating the catch and also a dead lock.

13 Claims, 6 Drawing Figures

LOCK ASSEMBLIES

This invention relates to fastening devices for securing two members together. The invention is especially applicable to locks for doors and the two members may be a door and its frame or the two doors of a pair.

Many forms of locking devices have been proposed for this and similar purposes. Some make use of a hasp which is hinged to one of the members and engages over a staple or the like projecting from the other member. Another form of lock which offers valuable advantages is described in our Application Ser. No. 450,066. It makes use of a hasp which is hinged to one member and which fits over a stud mounted on the other member, on which stud a special form of locking member is then secured to hold the hasp on the stud.

It is an object of the present invention to provide further improvements in such lock assemblies which give useful advantages both over known arrangements and over the locks described in our said Application Ser. No. 450,066.

A further object of the present invention is to provide such an improved lock which uses a plate which is pivoted to one of the members for movement in a plane parallel to the face thereof and which is formed with a slot for engagement with the stud on which it is held by the locking member by the engagement of the latter in a recess formed in said plate.

Yet another object of the present invention is to provide a lock assembly comprising a stud for mounting on one member, a plate for pivotal mounting on the other member and a locking member for locking the plate engaged with the stud, wherein the locking member contains a hollow cylinder which is slidable in it and on to the stud, means including a ball carried in the wall of the cylinder for engagement in a groove in the stud and improved catch means for retaining the cylinder and the said ball in their locked positions, which catch means preferably include a ring lock surrounding said cylinder.

A still further object of this invention is the provision of an improved form of lock assembly in which the locking member includes a dead lock.

Further features and advantages of the invention will become clear from the following description of a preferred embodiment. Reference will be made to the accompanying drawing, in which.

Figure 1:
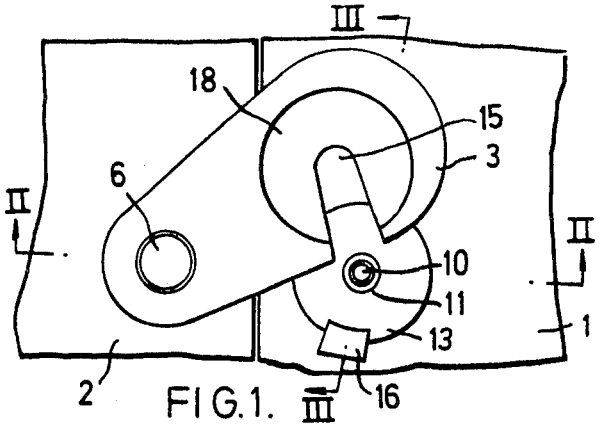
FIG. 1 is a front view of parts of the assembly, which is shown mounted but with the parts in their unlocked positions and before the fitting of the locking member.
Figure 2:
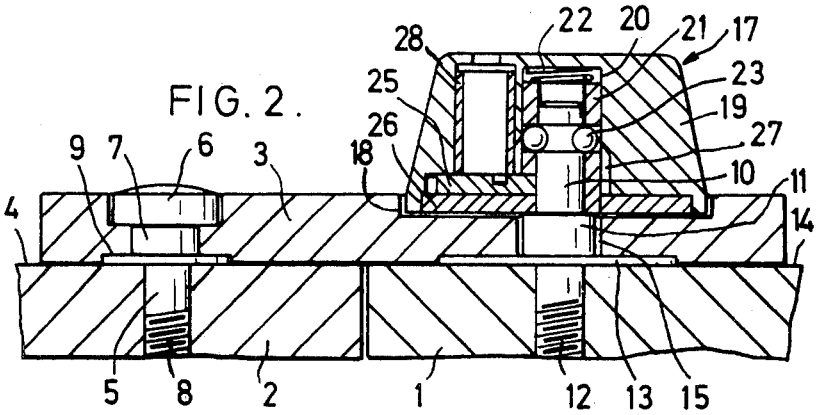
FIG. 2 is a part-sectional view to a larger scale taken on the line II—II of FIG. 1 but with the parts in their locked positions and after the locking member has been fitted.
Figure 3:
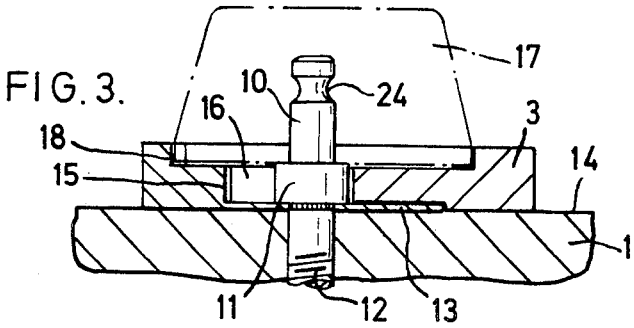
FIG. 3 is a similar part-sectional view taken on the line III—III of FIG. 1, the locking member being shown only in broken lines.

Referring to FIGS. 1 to 3, the references 1 and 2 indicate two members which are to be locked together. They may be a door 1 and its frame 2 or they may be two doors of a pair.

A plate 3, which is shaped as shown, is pivoted to the member 2 so that it can swing in a plane parallel to the front face 4 of the latter. The mounting is by means of a bolt 5 having a head 6, a neck 7, about which the plate 3 pivots, and a threaded stem 8, which passes through the member 2 and is secured to it by means of a nut (not shown). The hole in the plate 3 through which the bolt 5 passes is shaped as shown in FIG. 2 to fit the neck 7 and accommodate the head 6, whilst there is also a recess to accommodate a washer 9.

A stud 10 having a body 11 and a threaded stud 12 is fixed to the member 1 by means of a nut (not shown), a disc 13 being clamped between the body 11 and the face 14 of the member 1. The plate 3 is formed with a slot 15 so that it can engage the body 11 of the stud 10, while the disc 13 carries a projection 16 which closes the end of the slot 15 when the assembly is locked.

The assembly also comprises a locking member 17 which is adapted to fit on the stud 10 and to engage in a circular recess 18 formed in the plate 3.

The locking member 17 is similar to one of those described in the specification of the said Application No. 450,066 to which reference should be made. Briefly it comprises a body 19 formed with a central bore 20 in which a cylinder 21 is slidable under the action of a spring 22. The walls of this cylinder 21 are formed with holes in which balls 23 are carried so that they can engage in a groove 24 in the stud 10.

A catch 25 is fitted in the body 19, where it is held by a bottom plate 26 so that it can be moved into a locking position, as shown in FIG. 2, in which it holds the cylinder 21 against the force of the spring 22, and a release position in which the cylinder can be moved down by the spring. In the first position the balls 23 are held in the groove 24, whereas in the second position they are allowed to move outwardly, by virtue of an enlargement 27 of the bore 20, to disengage themselves from the groove 24. The catch 25 is actuated by a key-operated cylinder lock 28.

The use the locking assembly of the invention, the plate 3 is pivoted about the bolt 5 from the position shown in FIG. 1 to a position corresponding to that shown in FIGS. 2 and 3 in which the body 11 of the stud 10 is fully engaged in the slot 15 and the end of the slot is closed by the projection 16.

The locking member 17, which then has the catch 25 in its release position and the cylinder 21 in its lower position, is now pressed onto the stud 10. The effect of this is to force the cylinder 21 back against the spring 22 and thus force the balls 23 into the groove 24, so that they hold the member 17 on the stud 10 and thereby prevent the plate 3 from being disengaged from the latter. The catch 25 can then be operated by the cylinder lock 28 to lock the assembly and thus the doors 1 and 2 against unauthorised opening.

The pivotal mounting of the plate 3 on the bolt 5 with the head 6 of the latter within the plate and protected by it, the close engagement of the member 17 in the recess 18 and the way in which the projection 16 closes the end of the slot 15 together provide a lock assembly which is neat in appearance, easy to operate and which is very difficult to force.

Figure 4:
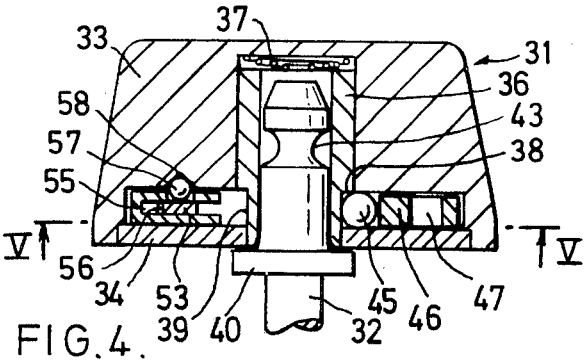
FIG. 4 is a section, on the line IV—IV of FIG. 5, through an improved locking member showing further features of the present invention, the member being shown locked on the stud.
Figure 5:
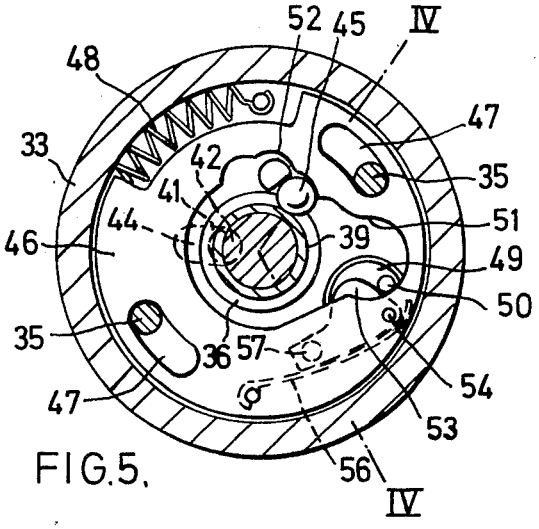
FIG. 5 is a section taken on the line V—V of FIG. 4.
Figure 6:
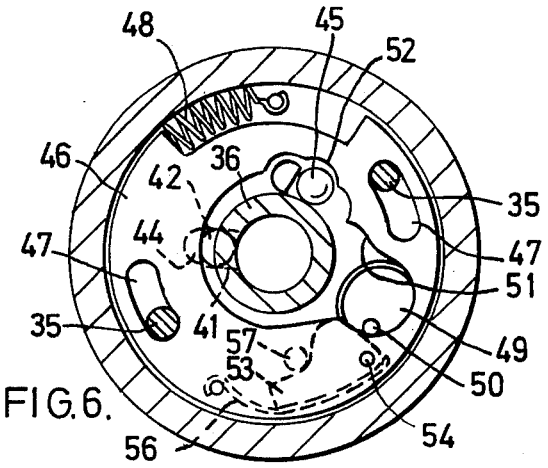
FIG. 6 is a section similar to FIG. 5 but showing the parts of the mechanism in their unlocked positions.

Referring now to FIGS. 4 to 6, these show an improved locking member which offers further advantages when used in place of the member 17 of FIGS. 1 to 3.

This locking member 31, which is shown locked on a stud 32, comprises a body 33 formed of hardened steel which contains the locking mechanism and the bottom of which is closed by a plate 34 held by screws 35. Within the body 33 is a cylinder 36 (similar to the cylinder 21) which is a close fit on the stud 32. This cylinder 36 is axially slidable within the body 33 and is urged by a spring 37 towards the plate 34. This cylinder is stepped at 38 to provide an end 39 of reduced diameter which projects through an opening in the plate 34 so that it engages a collar 40 on the stud 32 when the locking member 31 is pressed on to the latter. The maximum movement of the cylinder 36 when the member 31 is removed from the stud 32 is limited by the engagement of the step 38 against the plate 34.

The wall of the cylinder 36 is formed with a hole, indicated at 41 in FIGS. 5 and 6, in which is fitted a steel ball 42 the diameter of which is greater than the thickness of the wall of the cylinder. The position of the hole 41 is such that when the cylinder 36 is forced into its upper position in the body 33 the ball 42 engages in an annular groove 43 formed in the stud 32. In this position of the cylinder it is closely surrounded by the body 33 which holds the ball 42 in the recess 43, thus locking the member 31 on the stud 32 when the cylinder 36 is held in this position by the locking mechanism which is to be described. With this mechanism unlocked, however, the cylinder 36 can be moved down in the body 33 by action of the spring 37 because of the provision of a recess 44 in the body 33 immediately below the groove 43, the ball 42 then moving out of the groove 43 and into the recess 44.

The cylinder 36 is held in its upper locked position by locking mechanism comprising a ball 45 which is forced by a cam ring 46 under step 38, as shown in FIG. 4. This cam 46 is formed with arcuate slots 47, through which the screws 35 pass, to allow limited rotation of the cam from the locked position shown in FIG. 5, to which it is urged by a compression spring 48, and the unlocked position shown in FIG. 6. This movement is effected by the action of a cylinder lock 49 (similar to lock 28 of FIG. 2) which is mounted in the body 33 and carries a projecting pin 50 which engages the inner cam surface 51 of the cam 46.

The cam surface 51 is so shaped where it engages the ball 45 that when the cam 46 is moved to its locked position shown in FIG. 5 the ball 45 is forced under the step 38 of the cylinder 36, where it is held, whereas when the cam 46 is turned to the unlocked position shown in FIG. 6, the ball 45 moves outwardly into a hollow 52 in the cam, which allows outward movement of the cylinder 36.

According to a further preferred feature of this invention the locking mechanism also includes a dead lock. In the construction shown in FIGS. 4 to 6, this comprises a pawl 53 which is pivoted at 54 in a slot 55 in the cam 46 and which is shaped so that it is engaged by the pin 50, against which it is pressed by a leaf-spring 56.

A ball 57 located in a hole formed in the top of the cam 46 is held by the pawl 53 in a recess 58 in the body 33 when the pawl is in its locking position as shown in FIGS. 4 and 5. Operation of the cylinder lock to unlock the device, which rotates the cylinder 49 in an anti-clockwise direction is viewed in FIGS. 5 and 6, causes the pin 50 to pivot the pawl 53 outwardly until it is clear of the ball 57, which then drops out of the recess 58 and unlocks the cam 46. Continued movement of the pin 50 then turns this cam to bring it to its unlocked position as shown in FIG. 6.

This locking mechanism provides a number of advantages including particularly the provision of a dead-lock and of novel and improved mechanism for locking the cylinder 36 in its locking position when the member 31 is on the stud 32.

We claim:

1. A lock assembly for locking two relatively movable members together, comprising a stud adapted to be fixed to one of said members so as to project from a face thereof, a plate formed with a slot extending inwardly from one edge thereof and with a recess in one of its faces around an inner end of said slot, means for pivotally mounting said plate on a face of the other of said members for movement in a plane parallel thereto to engage said stud in said slot when said members are in position for locking, said recess being on the outer exposed face of said plate, and a locking member having locking means for locking it on said stud with said member engaged in said recess so that it retains said plate engaged with said stud, said locking means then allowing free rotation of said locking member on said stud while preventing the pivoting of said plate to disengage it from said stud.

2. A lock assembly according to claim 1, wherein said locking member and recess are both circular in section so that said locking member fits closely in and is rotatable in said recess.

3. A lock assembly according to claim 1, wherein said stud is provided with a projection which closes the end of said slot in said plate when the assembly is in its locked condition.

4. A lock assembly according to claim 1, wherein said stud is provided with a disc part which engages the surface of the first said member and wherein said plate is formed with a recess on its inner face in which said disc is engaged when the assembly is in its locked condition.

5. A lock assembly according to claim 4, wherein the said disc part carries a projection which closes the end of said slot when the assembly is in its locked condition.

6. A lock assembly according to claim 1, wherein said stud is formed with an annular groove and wherein said locking member includes at least one ball and means for retaining said ball in said groove when the locking member is locked on said stud.

7. A lock assembly according to claim 6, wherein said locking means comprise a spring-operated cylinder, which is slidable within said locking member and also onto said stud when the locking member is fitted on the latter, between a locking position, in which said ball is held in said groove and secures said locking member on said stud, and a release position, in which said ball is free to disengage from said groove, and wherein said locking member includes a catch for locking said cylinder and a key-operated lock for releasing said catch.

8. A lock assembly according to claim 7, wherein said catch is a ring catch surrounding said cylinder.

9. A lock assembly according to claim 6, wherein a ball is interposed between said ring catch and said cylinder, which it holds in its locked position.

10. A lock assembly according to claim 7, which includes a dead lock which holds said catch in its locking position and which must be released by said key-operated lock before the latter can release said catch.

11. A lock assembly according to claim 1, wherein said stud is formed with an annular groove and said locking means comprises a hollow cylinder which is slidable in said locking member and on to said stud, at least one ball movable in the wall of said cylinder between an inner position in which it is held in said groove when the assembly is locked on said stud and from which it is free to move when said cylinder is moved to a release position in said locking member, a ring catch surrounding said cylinder, and a key-operated lock for moving said ring catch between one position in which said cylinder is held in its locking position and another position in which said cylinder is released to allow removal of said locking member from said stud.

12. A lock assembly according to claim 11 which also includes a dead lock for holding said ring catch in its first said position and which must be operated by said key-operated lock before said catch can release said cylinder.

13. A lock assembly according to claim 12 wherein said key-operated lock is a cylinder lock and said dead lock and ring catch are operated by a pin on the end of said cylinder lock.

* * * * *